US010581173B1

(12) United States Patent
Grady et al.

(10) Patent No.: US 10,581,173 B1
(45) Date of Patent: Mar. 3, 2020

(54) ON-BODY, INWARD-FACING ANTENNAS

(71) Applicants: Michael Dante Grady, Smyrna, GA (US); Thomas McCrea Weller, Tampa, FL (US)

(72) Inventors: Michael Dante Grady, Smyrna, GA (US); Thomas McCrea Weller, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 15/943,986

(22) Filed: Apr. 3, 2018

Related U.S. Application Data

(60) Provisional application No. 62/480,739, filed on Apr. 3, 2017.

(51) Int. Cl.
*H01Q 15/00* (2006.01)
*H01Q 1/22* (2006.01)
*H01Q 1/38* (2006.01)

(52) U.S. Cl.
CPC ..... *H01Q 15/006* (2013.01); *H01Q 1/22* (2013.01); *H01Q 1/38* (2013.01)

(58) Field of Classification Search
CPC ..... H01Q 9/0478
See application file for complete search history.

(56) References Cited

U.S. PATENT DOCUMENTS 8,922,452 B1 12/2014 O'Brien
2012/0032865 A1* 2/2012 Toyao ..... H01P 1/2005 343/835
2012/0162001 A1* 6/2012 Sim ..... H01Q 17/008 342/4

OTHER PUBLICATIONS

Bell et al., "A Low-Profile Archimedean Spiral Antenna Using an EBG Ground Plane", IEEE Antennas and Wireless Propagation Letters, vol. 3, pp. 223-226, 2004 (Year: 2004).*
Q. Bonds, J. Gerig, T. M. Weller, and P. Herzig, "Towards Core Body Temperature Measurement via Close Proximity Radiometric Sensing," Sensors Journal, IEEE, vol. 12, pp. 519-526, 2012.
Z. Popovic, P. Momenroodaki, and R. Scheeler, "Toward wearable wireless thermometers for internal body temperature measurements," Communications Magazine, IEEE, vol. 52, pp. 118-125, 2014.
K. L. Carr, "Antenna: the critical element in successful medical technology," in Microwave Symposium Digest, 1990, IEEE MTT-S International, 1990, vol. 1, pp. 525-527.
S. Jacobsen and P. Stauffer, "Performance Evaluation of Various Antenna Configurations for Microwave Thermography During Superficial Hyperthermia," Journal of Electromagnetic Waves and Applications, vol. 15, pp. 111-134, 2001.
Q. Bonds, T. Weller, B. Roeder, and P. Herzig, "A tunable Cavity Backed Slot Antenna (CBSA) for close proximity biomedical sensing applications," in 2009 IEEE International Conference on Microwaves, Communications, Antennas and Electronics Systems, pp. 1-5.

(Continued)

*Primary Examiner* — Daniel Swerdlow
(74) *Attorney, Agent, or Firm* — Thomas | Horstemeyer, LLP

(57) ABSTRACT

In some embodiments, an antenna includes a dielectric substrate having a first surface and a second surface opposite to the first surface, a planar central antenna element provided on the first surface, and a planar electromagnetic bandgap structure provided on the first surface and surrounding the central antenna element.

14 Claims, 12 Drawing Sheets

(56) References Cited

OTHER PUBLICATIONS

S. Jacobsen and Ø. Klemetsen, "Improved Detectability in Medical Microwave Radio-Thermometers as Obtained by Active Antennas," IEEE Transactions on Biomedical Engineering, vol. 55, pp. 2778-2785, 2008.
T. Sugiura, Y. Kouno, A. Hashizume, H. Hirata, J. W. Hand, Y. Okita, and S. Mizushina, "Five-band microwave radiometer system for non-invasive measurement of brain temperature in new-born infants: system calibration and its feasibility," in The 26th Annual International Conference of the IEEE Engineering in Medicine and Biology Society, 2004, pp. 2292-2295.
J. W. Hand, S. Van Leeuwen Gm Fau-Mizushina, J. B. Mizushina S Fau-Van de Kamer, K. Van de Kamer Jb Fau-Maruyama, T. Maruyama K Fau-Sugiura, D. V. Sugiura T Fau-Azzopardi, A. D. Azzopardi Dv Fau-Edwards, and A. D. Edwards, "Monitoring of deep brain temperature in infants using multi-frequency microwave radiometry and thermal modelling," Institute of Physics Publishing, Physics in Medicine and Bilology. 46. 2001, pp. 1885-1903.
L. Dubois, J. J. Pribetich J Fau-Fabre, M. Fabre Jj Fau-Chive, Y. Chive M Fau-Moschetto, and Y. Moschetto, "Non-invasive microwave multifrequency radiometry used in microwave hyperthermia for bidimensional reconstruction of temperature patterns," 19930721 DCOM—19930721, Int. J. Hyperthermia, 1993, vol. 9, pp. 415-431.
Ø. Klemetsen and S. Jacobsen, "Improved Radiometric Performance Attained by an Elliptical Microwave Antenna With Suction," IEEE Transactions on Biomedical Engineering, vol. 59, pp. 263-271, 2012.
M. A. Ertürk, A.-M. M. El-Sharkawy, and P. A. Bottomley, "Monitoring local heating around an interventional MRI antenna with RF radiometry," Medical Physics, vol. 42, pp. 1411-1423, 2015.
D. B. Rodrigues, P. F. Maccarini, S. Salahi, T. R. Oliveira, P. J. S. Pereira, P. Limão-Vieira, B. W. Snow, D. Reudink, and P. R. Stauffer, "Design and Optimization of an Ultra Wideband and Compact Microwave Antenna for Radiometric Monitoring of Brain Temperature," IEEE Transactions on Biomedical Engineering, vol. 61, pp. 2154-2160, 2014.
P. R. Stauffer, B. W. Snow, D. B. Rodrigues, S. Salahi, T. R. Oliveira, D. Reudink, and P. F. Maccarini, "Non-Invasive Measurement of Brain Temperature with Microwave Radiometry: Demonstration in a Head Phantom and Clinical Case," The neuroradiology journal, vol. 27, pp. 3-12, 2014.
D. B. Rodrigues, P. F. Maccarini, S. Salahi, E. Colebeck, E. Topsakal, P. J. S. Pereira, P. Limao-Vieira, and P. R. Stauffer, "Numerical 3D modeling of heat transfer in human tissues for microwave radiometry monitoring of brown fat metabolism," Proceedings of SPIE, vol. 8584, pp. 1-12, 10.1117/12.2004931, 2013.
B. W. Snow, K. Arunachalam, V. De Luca, P. F. Maccarini, Ø. Klemetsen, Y. Birkelund, T. J. Pysher, and P. R. Stauffer, "Non-invasive vesicoureteral reflux detection: Heating risk studies for a new device," Journal of pediatric urology, vol. 7, pp. 624-630, 2011.
S. Jacobsen, A. Murberg, and P. R. Stauffer, "Characterization of a Tranceiving Antenna Concept for Microwave Heating and Thermometry of Superficial Tumors—Abstract," Journal of Electromagnetic Waves and Applications, vol. 12, pp. 351-352, Jan. 1, 1998 1998.
G. H. Miranda, R. V. Iyer, and S. Pamidighantam, "Analysis and Optimization of Dual Arm, Center Excited, Surface Micromachined Archimedean Spiral Antenna with Improved Wideband Characteristics," in COMSOL Conference 2011, Bangalore, India, 13 pages.
S. Bosch, J. Ferre-Borrull, N. Leinfellner, and A. Canillas, "Effective dielectric function of mixtures of three or more materials: a numerical procedure for computations," Surface Science vol. 453, pp. 9-17, 2000.
M. Grady and T. M. Weller, "Using resistive loading to control the radiation efficiency of a spiral antenna," in WAMICON 2014, pp. 1-4.
Y. Fan and Y. Rahmat-Samii, "Microstrip antennas integrated with electromagnetic band-gap (EBG) structures: a low mutual coupling design for array applications," IEEE Transactions on Antennas and Propagation, vol. 51, pp. 2936-2946, 2003.
D. Sievenpiper, Z. Lijun, R. F. J. Broas, N. G. Alexopolous, and E. Yablonovitch, "High-impedance electromagnetic surfaces with a forbidden frequency band," IEEE Transactions on Microwave Theory and Techniques, vol. 47, pp. 2059-2074, 1999.
S. Raza, "Characterization of the Reflection and Dispersion Properties of 'Mushroom'-related Structures and their Applications to Antennas," Electrical and Computer Engineering, University of Toronto, 2012, pp. 1-110.
"IEEE Standard Definitions of Terms for Antennas," IEEE Std 145-1993(R2004), pp. 1-32, 1993.
H. A. Wheeler, "Fundamental limitaions of a small VLF antenna for submarines," Antennas and Propagation, IRE Transactions on, vol. 6, pp. 123-125, 1958.
H. A. Wheeler, "Useful radiation from an underground antenna," Journal of Research of the National Bureau of Standards—Section D. Radio Propagation, vol. 65D, pp. 89-91, 1961.
R. C. Hansen, "Radiation and reception with buried and submerged antennas," Antennas and Propagation, IEEE Transactions on, vol. 11, pp. 207-216, 1963.
R. K. Moore, "Effects of a surrounding conducting medium on antenna analysis," Antennas and Propagation, IEEE Transactions on, vol. 11, pp. 216-225, 1963.
A. Karlsson, "Physical limitations of antennas in a lossy medium," Antennas and Propagation, IEEE Transactions on, vol. 52, pp. 2027-2033, 2004.
K. Kim, S. Yun, S. Lee, S. Nam, Y. J. Yoon and C. Cheon, "A Design of a High-Speed and High-Efficiency Capsule Endoscopy System," IEEE Transactions on Biomedical Engineering, vol. 59, pp. 1005-1011, 2012.
J. Lee and S. Nam, "Q Evaluation of Antennas in an Electrically Conductive Medium," IEEE Transactions on Antennas and Propagation, vol. 56, pp. 2116-2120, 2008.
J. Lee and S. Nam, "Effective Area of a Receiving Antenna in a Lossy Medium," IEEE Transactions on Antennas and Propagation, vol. 57, pp. 1843-1845, 2009.
T. Dissanayake, K. P. Esselle, and M. R. Yuce, "Dielectric Loaded Impedance Matching for Wideband Implanted Antennas," IEEE Transactions on Microwave Theory and Techniques, vol. 57, pp. 2480-2487, 2009.
V. T. Nguyen and C. W. Jung, "Impact of Dielectric Constant on Embedded Antenna Efficiency," International Journal of Antennas and Propagation, vol. 2014, pp. 1-7, 2014.
Wen-Tzu Chen and Huey-Ru Chuang, "Numerical computation of human interaction with arbitrarily oriented superquadric loop antennas in personal communications," IEEE Transactions on Antennas and Propagation, vol. 46, pp. 821-828, 1998.
Gu, et al., "Wireless smart sensor with small spiral antenna on Si-substrate", Microelectronics Journal 42, 2011, 1066-1073.
Zhang, et al., "On-body measurements of embroidered spiral antenna", Loughborough University, LAPC 2015.
Alhorre, Faris Sadek, "UWB Single Arm Spiral Antenna on an EBG Substrate", Texas Tech University, Dec. 2007.
Collin, et al., "Human implanted spiral antenna for a 2.45GHz wireless temperature and pressure SAW sensor system" IEEE, 2008.
Grady, et al., "Human Body Sensing Antenna Surrounded by a Cylindrically Symmetric Electromagnetic Bandgap (EBG) Surface: an Improvement in the front-to-back ratio of on-body inward facing antennas", IEEE Antennas and Wireless Propagation Letters; Mar. 5, 2008.

* cited by examiner

ON-BODY, INWARD-FACING ANTENNAS

CROSS-REFERENCE TO RELATED APPLICATION

This application claims priority to U.S. Provisional Application Ser. No. 62/480,739, filed Apr. 3, 2017, which is hereby incorporated by reference herein in its entirety.

NOTICE OF GOVERNMENT-SPONSORED RESEARCH

This invention was made with Government support under grant contract number ECCS0901779 awarded by National Science Foundation. The Government has certain rights in the invention.

BACKGROUND

Microwave radiometric sensing is a means to realize portable, non-invasive, wireless thermometry in order to detect subsurface core body temperatures. The antennas used in microwave radiometry have special considerations in that they must meet high beam efficiency, low ohmic loss, narrow beam solid angle, and high input matching requirements. The antenna can be regarded as one of the most critical components limiting radiometer system performance as being viable for both treatment and detection in the biomedical realm.

Human body antenna designs should explicitly show that all requirements for successfully sensing have been met. Many antenna designs for human body sensing have been presented that exhibit adequate in-band return loss (≥10 dB), but the radiation characteristics are not always provided. Significant shortcomings in the antenna pattern can be masked if the radiation pattern is not provided. Particularly, the antenna should radiate in the broadside direction toward the body and should not be sensitive to the ambient environment nor other areas outside of the body. It is well documented that unwanted and augmented side lobes occur when surface waves reach the edge of a finite ground plane and radiate into the propagation medium. This surface wave propagation negatively affects both the efficiency and radiation pattern of planar antennas and must be mitigated in order to accurately sense while the antenna is on-body.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
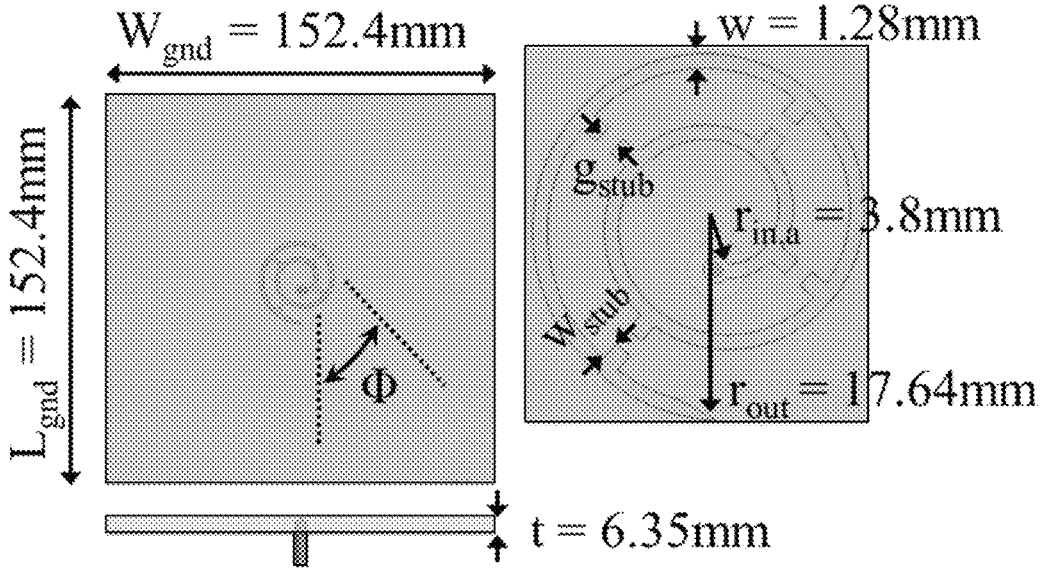
FIG. 1 (PRIOR ART)
FIG. 1 is a schematic view of a conventional planar antenna.

As noted above, unwanted and augmented side lobes occur when surface waves reach the edge of a finite ground plane of an on-body, inward-facing antenna and such side lobes negatively affect both the efficiency and radiation pattern of the antenna. It can, therefore, be appreciated that it would be desirable to have antennas for on-body microwave radiometric sensing that are less susceptible to surface wave propagation. Disclosed herein are examples of such antennas. In some embodiments, the antennas comprise an electromagnetic bandgap structure comprising multiple continuous, concentric conductors that surround a planar central antenna element and attenuate surface wave propagation. Such antennas can be made to have thicknesses less than one quarter wave of the radiation wavelength and, therefore, are particularly suitable for application to the skin of a human being or animal. In some embodiments, the antennas are incorporated into microwave radiometric sensors that can be used to measure core body temperature.

In the following disclosure, various specific embodiments are described. It is to be understood that those embodiments are example implementations of the disclosed inventions and that alternative embodiments are possible. All such embodiments are intended to fall within the scope of this disclosure.

This disclosure describes a design process for inward-facing antennas for on-body sensing. In one embodiment, an antenna comprises a quasi-corrugated, symmetric, electromagnetic bandgap structure that is used to mitigate unwanted side lobes that arise from on-body, inward-facing antennas. The effectiveness of the approach is highlighted by comparing the simulated and measured radiation characteristics of an on-body spiral antenna both with and without the electromagnetic bandgap structure. Experimental measurements show an improvement in the broadside gain, side gain, and rear gain of 3.84 dB, 2.64 dB, and 8 dB, respectively from the EBG antenna over the convention antenna. Likewise, simulations show an improvement in the broadside gain, side gain, and rear gain of 0 dB, 7 dB, and 7 dB, respectively. Main beam efficiency is improved from 45.33% and 54.43% for the conventional antenna to 87.59% and 86.36% for the EBG antenna for simulated and measured beam efficiencies, respectively.

Designing antennas for human body contact sensing imposes a number of restrictions that are specific to this unique case. Antenna input match along with radiation and beam efficiencies must be precisely known and maximized in this scenario. There exist few works in the literature that explicitly outline how to design antennas for on-body, inward-facing applications. Generally speaking, these works fail to discuss how to mitigate unwanted side lobes that are present within this application. A planar, one-arm Archimedean spiral antenna has been chosen as a candidate antenna element due to its wideband impedance characteristics, high efficiency, and the relative ease in realizing a feeding network. A design process is presented to attain satisfactory impedance match for an antenna in contact with a human tissue-mimicking phantom.

Archimedean spiral antennas are considered frequency independent because of the broadband pattern and impedance characteristics they exhibit. A one-arm Archimedean spiral antenna can be modeled using the curves specified in $$R_M = r_{in,M} + C_{exp}\Phi_{angle} \tag{1}$$

where M=curve 'a' or 'b', $R_M$ represents the radial distance along the surface, $C_{exp}$ is the expansion coefficient of spiral (equals 1 for Archimedean spiral), $\Phi_{angle}$ is the rotation angle which is equal to $2\pi\cdot$(# of spiral turns), $r_{in}$ is the inner radius of spiral at a rotation angle of zero, $r_{out}$ is the outer radius of spiral at the maximum rotation angle, and w is the spiral width which equals to $r_{in,b}(\Phi_{angle})-r_{in,a}(\Phi_{angle})$. The active region of a spiral (where coherent radiation occurs because currents along the spiral arms have identical phase) is realized when the circumference of the spiral equals one wavelength. The theoretical minimum, $f_{min}$, and maximum, $f_{max}$, frequency limit of operation are given in Equations (2) and (3), respectively $$f_{min} = \frac{c}{\left(2\pi \cdot r_{out}\sqrt{\varepsilon_{r,eff}}\right)} \tag{2}$$

-continued $$f_{max} = \frac{c}{\left(2\pi \cdot r_{in}\sqrt{\varepsilon_{r,eff}}\right)} \tag{3}$$

where c is the speed of light, $\varepsilon_{r,eff}$ is the effective relative permittivity of the propagation medium, $r_{in}=r_{in,a}(\Phi_0)$, and $r_{out}=C_{exp}\cdot\Phi_{max}+r_{in,b}(\Phi_0)$.

The design process for an on-body, inward-facing, one-arm Archimedean spiral antenna will now be described. The initial antenna dimensions can be obtained from Equations (2) and (3). A composite dielectric quantity is defined for the stratified body tissue layers. The composite or effective permittivity is the weighted sum of all dielectric constants for each tissue layer up to the plane-wave power penetration depth. The Lorentz-Lorenz effective medium approximation (EMA) is used to average the components into a composite material. The Lorentz-Lorenz EMA is shown by $$\frac{\varepsilon_{r,eff}-1}{\varepsilon_{r,eff}+2} = \sum_{i=1}^{N} y_i \frac{\varepsilon_i - 1}{\varepsilon_i + 2} \tag{4}$$

where $\varepsilon_i$ and $v_i$ are the complex dielectric constants and volume fractions, respectively, of layer "i" to a maximum layer number of N. The antenna is designed in a lossless effective propagation medium with no ground plane using the above spiral parameters. A substrate and ground plane are added to the design at a distance near to $\lambda_{eff}/4$ from the antenna element. Manufacturing process restrictions determine the closet obtainable substrate height to the $\lambda_{eff}/4$ distance. Dielectric losses are added to the full-space composite medium and the antenna parameters are re-tuned. The full-space medium is replaced by finite thickness stratified lossy tissue layers and the antenna is re-tuned. After a satisfactory impedance match is obtained, the radiation pattern is corrected.

Figure 2:
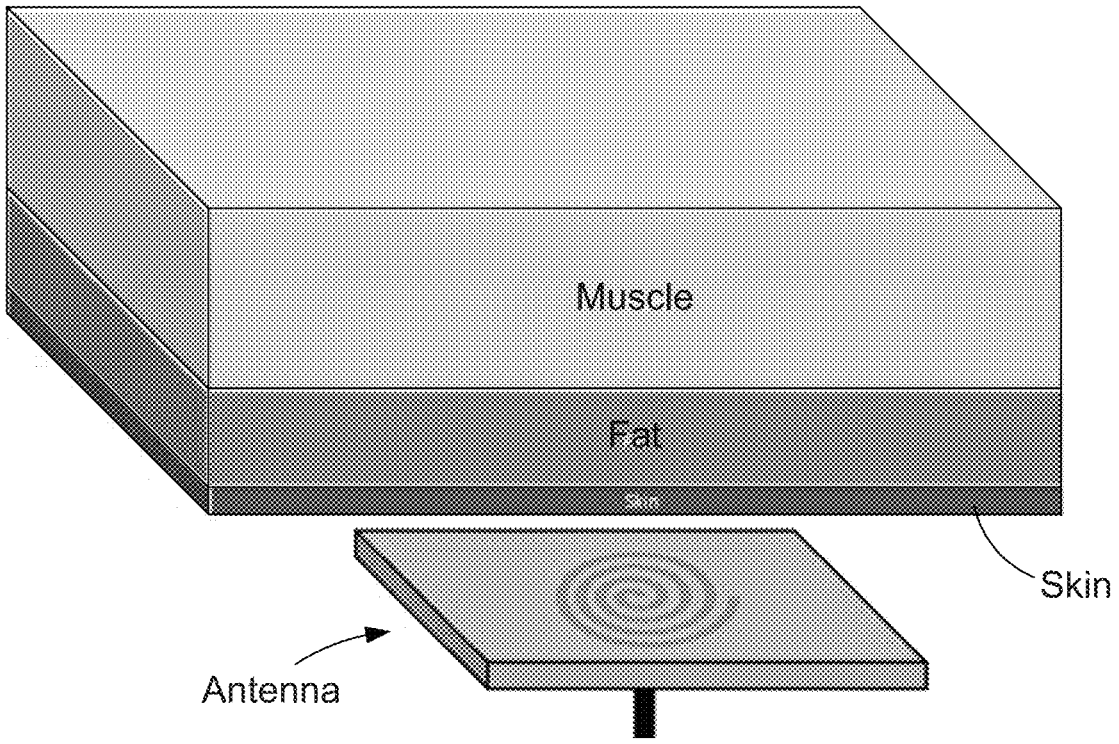
FIG. 2 is a schematic view of an experimental setup that emulates human tissue.

The structure and dimensions of one proposed antenna are illustrated in FIG. 1, An antenna was printed on a 6.35 mm-thick FR-4 substrate using a commercial printed circuit board printing process. The antenna was fed with a panel mount subminiature connector with an extruded polytetrafluoroethylene insulator. Open-ended stubs were inserted between the spiral windings to enable the integration of resistive loading in order to artificially emulate substrate loss. This artificial addition of loss is intended to control the radiation efficiency of the spiral antenna. A three-layer human tissue mimicking phantom representing skin, fat, and muscle was used during testing (see FIG. 2). The dielectric constant of the phantom was independently measured and was used as theoretical values during the design phase.

Figure 3:
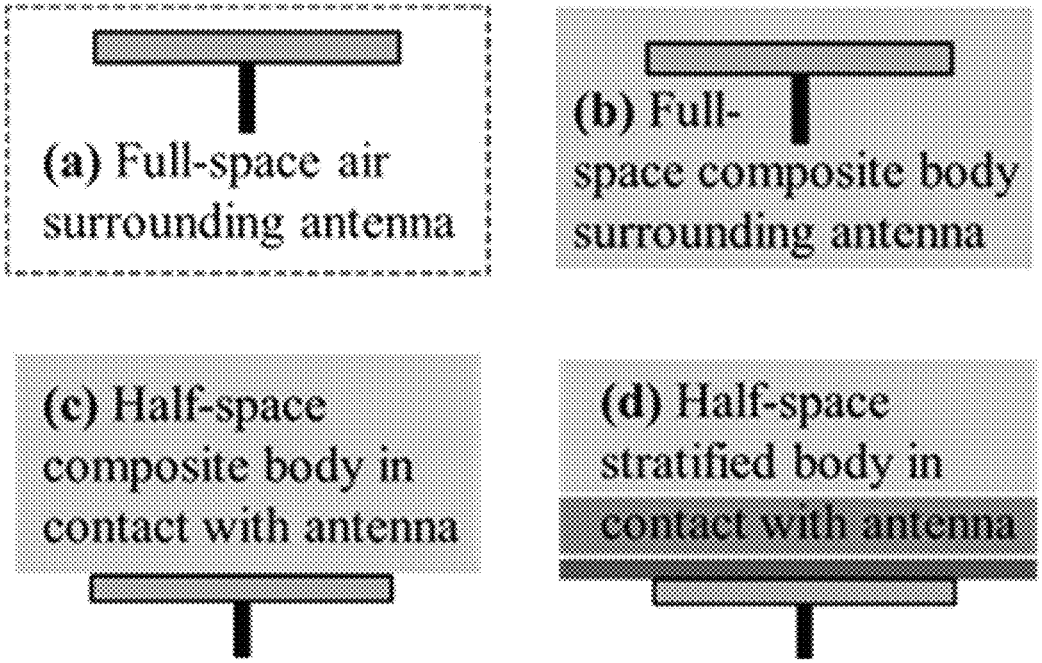
FIG. 3 is a schematic view that illustrates four different radiation propagation environments including: (a) full-space air, (b) a full-space composite body, (c) an infinite volume, upper half-space composite body, and (d) a finite volume, half-space stratified body.
Figure 4:
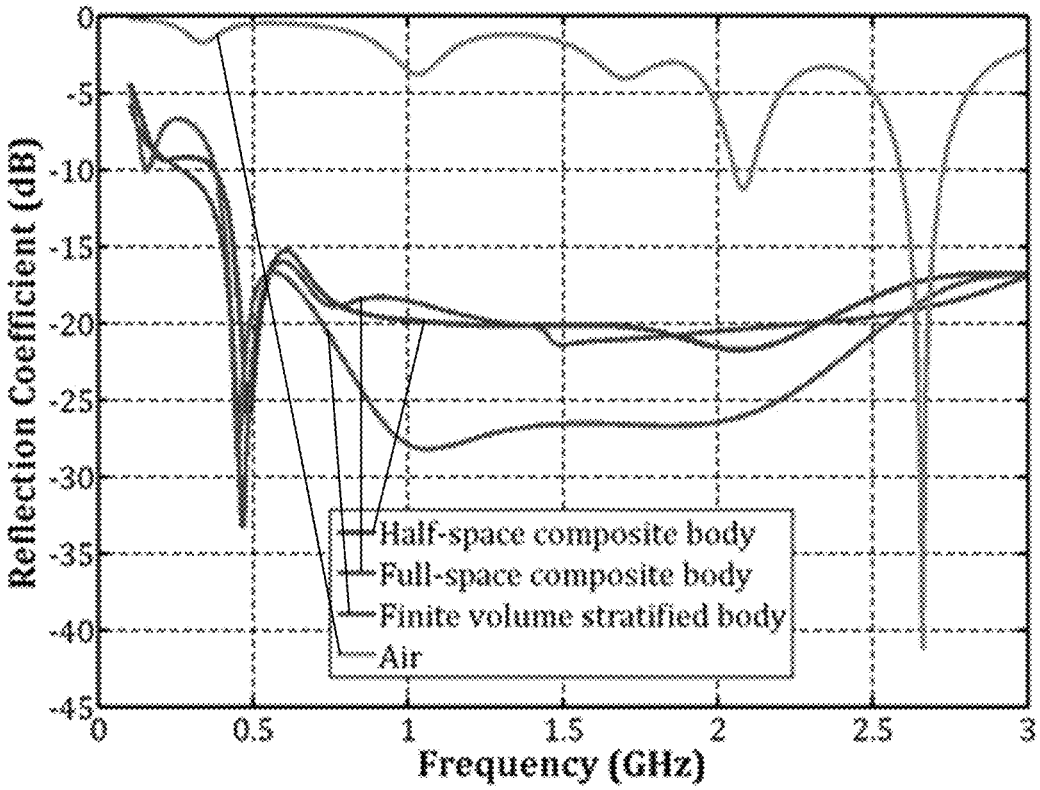
FIG. 4 is a graph that shows the simulated reflection coefficient for a conventional planar antenna within each of the propagation environments identified in FIG. 3.
Figure 5:
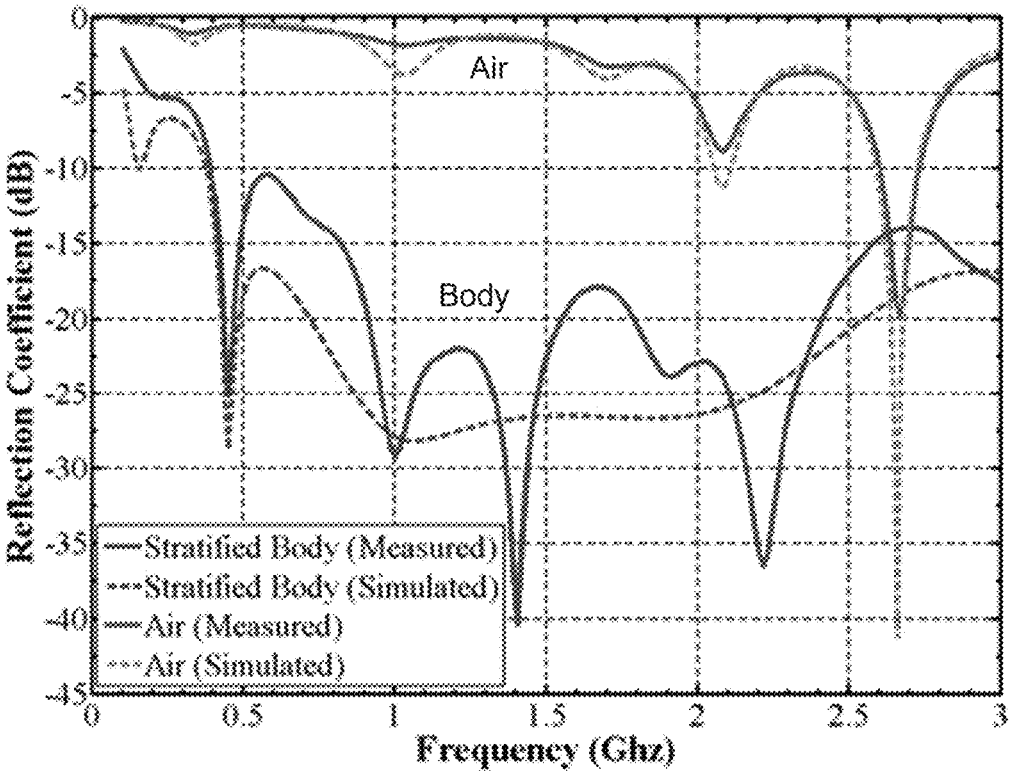
FIG. 5 is a graph that shows the measured and simulated reflection coefficient for the conventional planar antenna within the propagation environments (a) and (d) identified in FIG. 3.

The Ansys HFSS program was used to simulate the conventional antenna reflection coefficient across a frequency range of 0.1 to 3 GHz for four different propagation environments. The four propagation environments are illustrated in FIG. 3: (a) embedded in full-space air, (b) embedded within a full-space effective dielectric body, (c) in contact with an infinite volume upper half-space effective dielectric body, and (d) in contact with a finite volume multi-layered upper space dielectric body. FIG. 4 shows the simulated reflection coefficients for the conventional antenna with the four abovementioned cases. Each simulated case gives a similar reflection coefficient response. These reflection coefficient similarities imply that simpler design scenarios (the full-space and half-space composite setups) can be used as an initial approximation for more complex design scenarios (the stratified multi-layer setup). FIG. 5 compares the conventional antenna simulated and measured reflection coefficients for propagation environment's (a) in air and (d) in contact with a finite volume multilayer upper half-space dielectric body.

A network analyzer was used to measure the reflection coefficient for the fabricated conventional antenna in contact with the stratified human tissue phantom. The reflection coefficient for both the measured and simulated on-body sensing scenario was better than −10 dB over the frequency range of 0.4 to 3+ GHz. Likewise, the reflection coefficient was better than −20 dB over the frequency ranges of 0.9 to 1.55 GHz and 1.8 to 2.4 GHz for the measured on-body sensing scenario and better than −20 dB over the frequency range of 0.72 to 2.52 GHz for the same simulated scenario. The measured and simulated reflection coefficients for the antenna in the air matched reasonably well. However, the measured reflection coefficient for the on-body antenna exhibited more resonances than the simulated response. These differences are believed to be due to the uncertainty in the measurement of the actual permittivity value of the phantoms used during measurements. A notable difference between the simulation and actual setup lies in the assumption that there is a static dielectric constant per frequency for each individual phantom when in reality the actual phantom exhibits changes in the dielectric constant with spatial area and depth.

Figure 6:
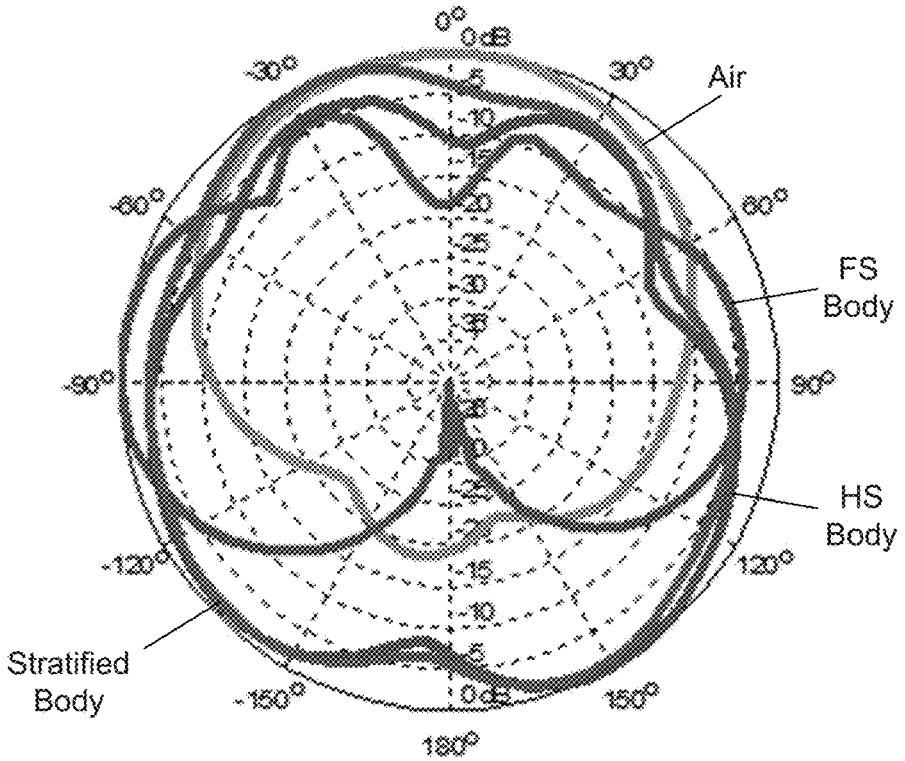
FIG. 6 is a diagram that shows the simulated radiation pattern for the conventional planar antenna within each of the propagation environments identified in FIG. 3.
Figure 7:
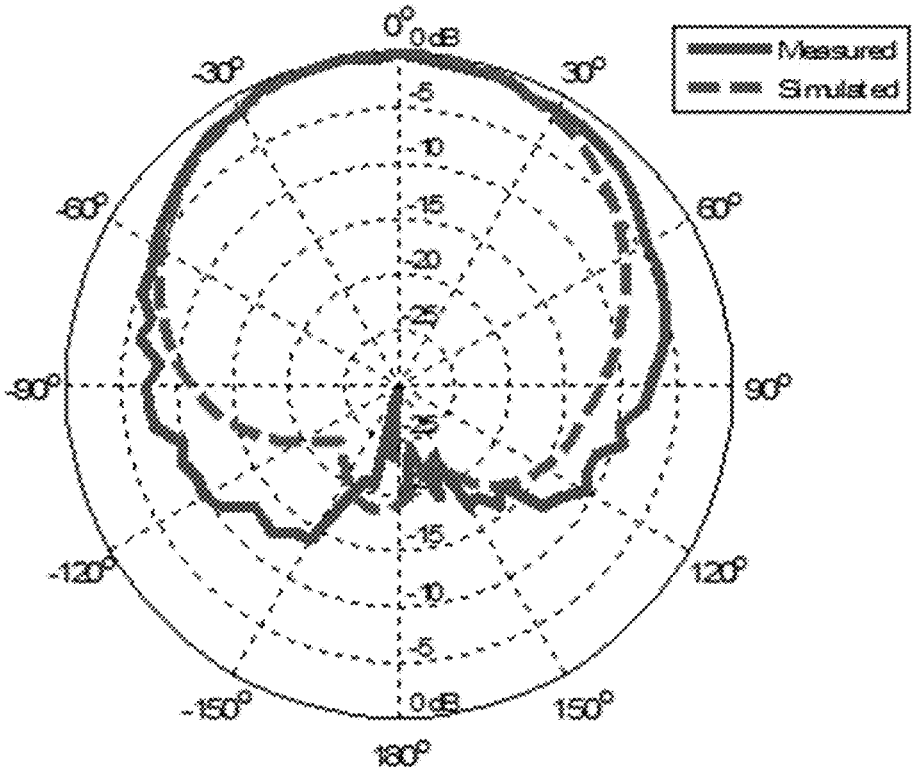
FIG. 7 is a diagram that shows the measured and simulated radiation pattern for the conventional planar antenna within full-space air.
Figure 8:
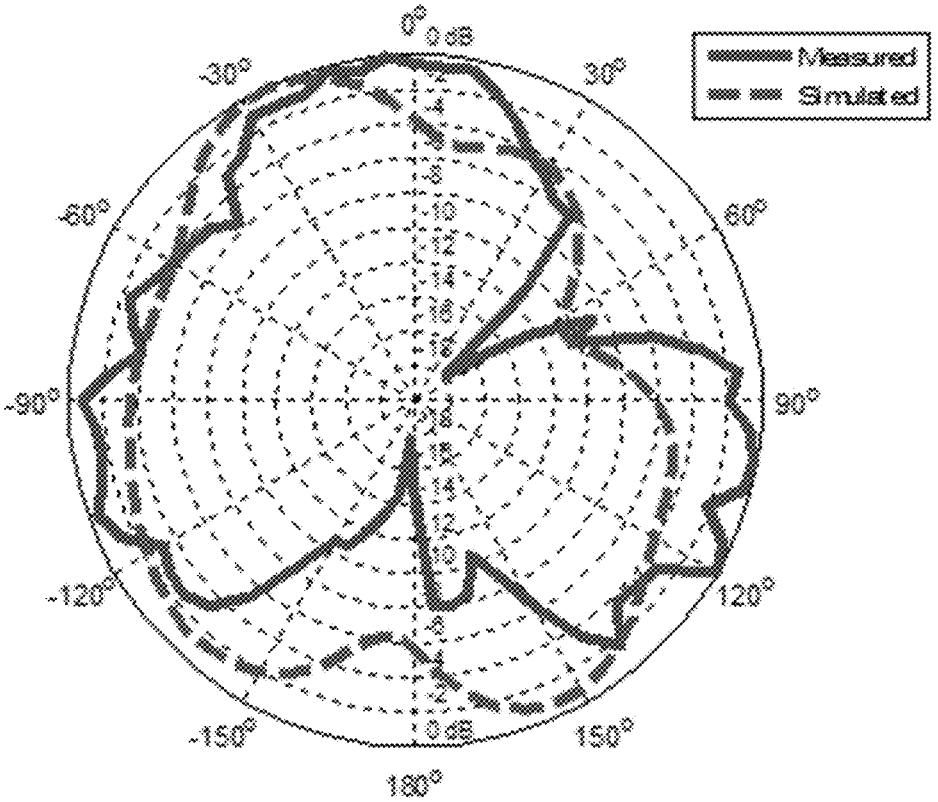
FIG. 8 is a diagram that shows the measured and simulated radiation pattern for the conventional planar antenna within a finite volume, half-space stratified body.

Ansys HFSS was also used to simulate the antenna radiation patterns at 1.4 GHz. The fabricated antenna radiation patterns were measured in an anechoic chamber. The normalized realized gains for the four simulated cases are given in FIG. 6. The antenna pattern was maximized in the side direction for the full-space case, while the pattern was maximized in the reverse direction for the half-space cases. The difference in the propagation environment is notable because the full-space lossy body (which emulates an embedded antenna) provided equal attenuation in all directions and helped to more evenly distribute the antenna pattern. The nulls in all patterns (which are more pronounced in the full-space pattern) were the result of surface wave propagation causing destructive interference. In contrast, on-body inward facing antennas only have attenuation in the forward direction from the body and no losses in all other directions from air. As the half-space patterns suggest, a surface wave suppression method must be implemented in order to ensure that the antenna has an adequate pattern for on-body sensing. Both half-space patterns are similar, which implies that the composite scenario can be used as an initial approximation for the stratified scenario. The measured and simulated radiation patterns for the antenna in air and in contact with the body are given in FIG. 7 and FIG. 8, respectively.

The simulated and measured main beam efficiency at 1.4 GHz for the propagation environment (d), where the spiral antenna is in contact with a finite volume multi-layered upper space dielectric body, were 45.33% and 54.43%, respectively.

The design of an in-plane continuous electromagnetic bandgap cylindrical structure is presented and integrated with the previous conventional spiral antenna design. Simulated and measured results are presented for a spiral antenna integrated with the electromagnetic bandgap structure. Radiation characteristics are compared for the scenarios with and without the electromagnetic bandgap structure.

Special attention must be paid to the design of inward facing on-body antennas in order to mitigate unwanted side lobes that arise in the antenna pattern. For microstrip antennas, these augmented side lobes can occur due to the unwanted propagation of surface waves. Dielectric slabs and metal surfaces over a ground plane (non-grounded structures) support surface waves. Surface waves radiate when discontinuities exist within an antenna structure. The surface waves that become trapped in the substrate, travel toward and lead to diffraction at the edges of a finite ground plane. This ground plane edge diffraction leads to unwanted radiation into the propagation medium. Surface wave propagation can negatively affect the efficiency and radiation pattern of a microstrip antenna and can also cause undesirable mutual coupling between neighboring devices.

Electromagnetic bandgap structures can be used to alter the geometry of a structure so that surface waves can be attenuated as they travel across the structure. A corrugated structure is a metal slab where vertical slots have been cut out. The slots are treated as a parallel-plate transmission line where the slot depth is typically one-quarter wavelength long. The ground plane (or short circuit) at the bottom of the slot is transformed into an open circuit at the top of the slot and this transformation results in a high impedance value. Describing this process in another way, the corrugated structure makes the ground plane appear electrically larger due to the current travelling a longer distance in contrast to a planar ground plane. Also, the slot depths can be reduced by introducing a loading material. Dielectric loading for the corrugated structure has drawbacks due to special machining, which is not practical, along with an increased cost and weight that is required to realize the one-quarter wavelength corrugated structure slot depth for lower frequencies.

The planar electromagnetic bandgap structure disclosed herein is an evolution from the corrugated structure. The basic premise of the proposed electromagnetic bandgap is that both dielectric loading and the inductance to ground can be increased to lower the electromagnetic bandgap structure resonance frequency. There must be many corrugations per wavelength, but the number of corrugations is managed with consideration to both the amount of available surface area on the substrate and the manufacturing process limitations (e.g., smallest feature size capability).

Figure 9A:
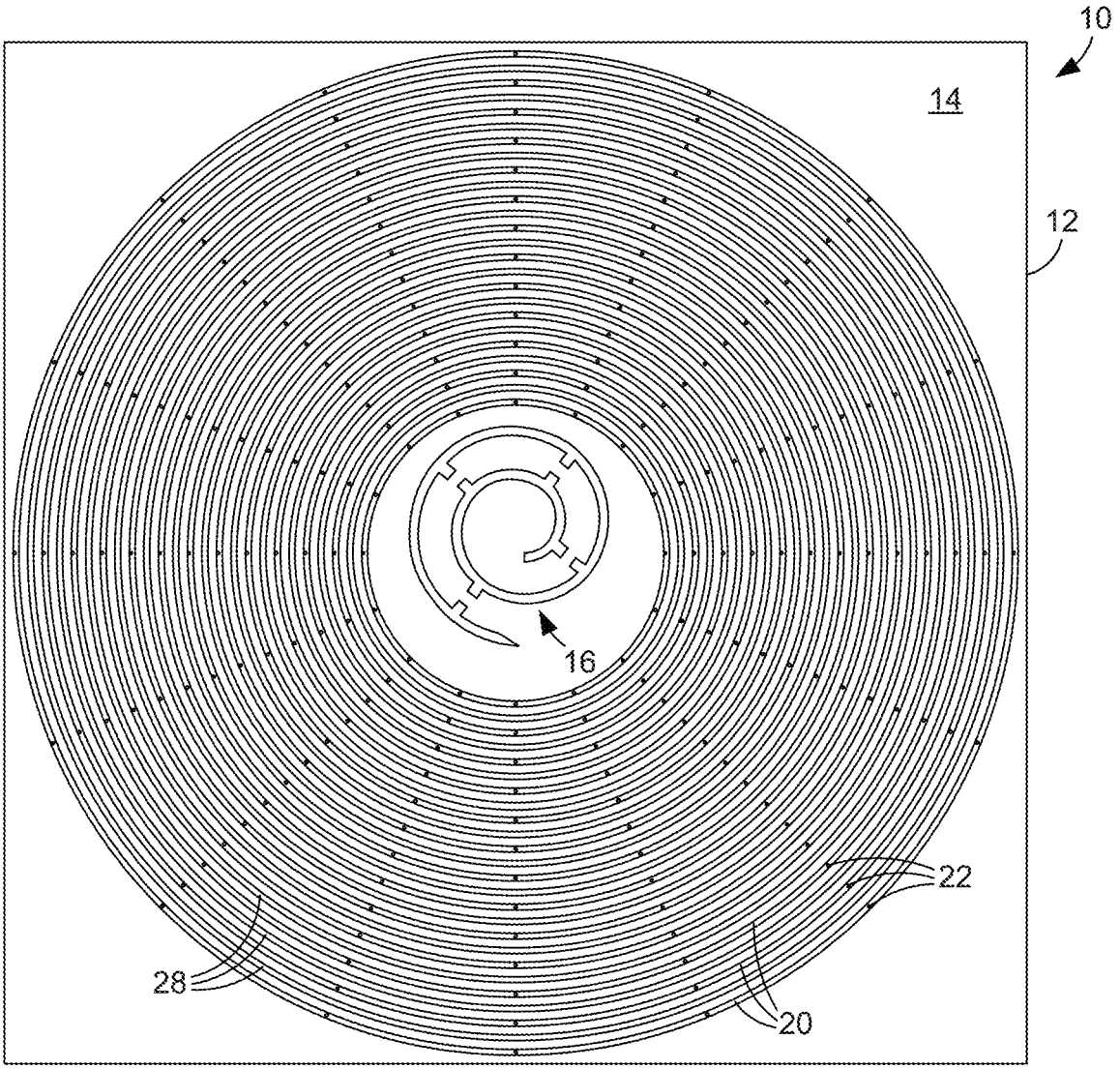
FIG. 9A is a top view of an embodiment of a novel antenna that incorporates an electromagnetic bandgap structure.
Figure 9B:
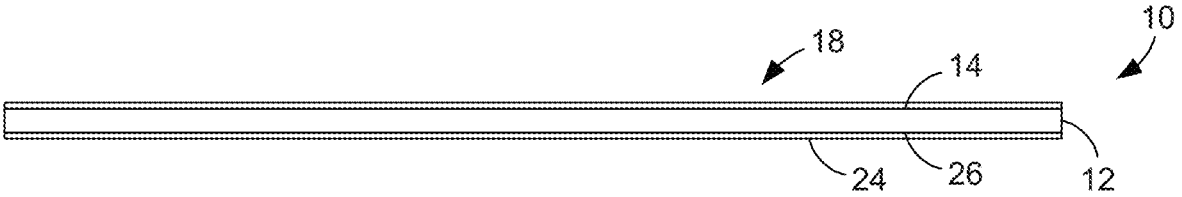
FIG. 9B is a side view of the antenna of FIG. 9A.
Figure 9C:
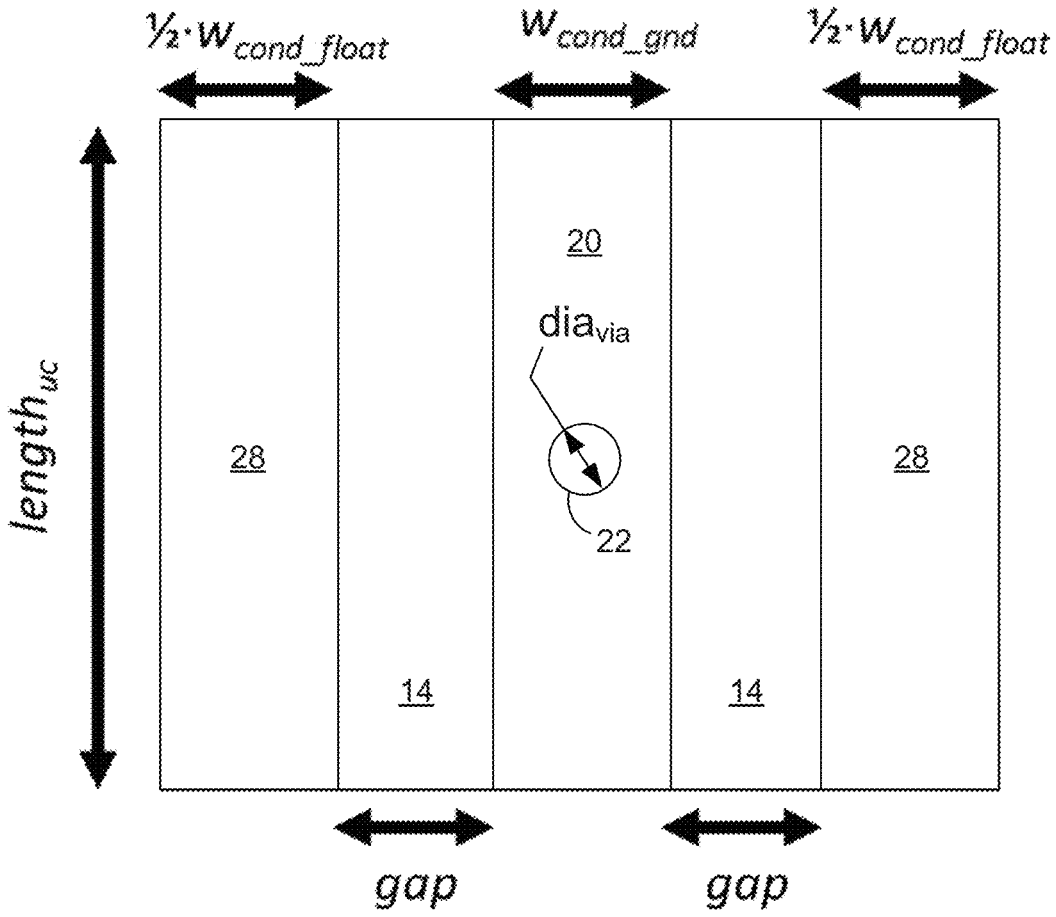
FIG. 9C is a detail view of a rectangular unit cell transformed from the radial unit cell of the electromagnetic bandgap structure shown in FIG. 9A.

FIGS. 9A-9C illustrate an example of an on-body, inward-facing antenna 10 that incorporates a planar electromagnetic bandgap structure. As shown best in FIG. 9A, the antenna 10 comprises a dielectric substrate 12 having a top surface 14 upon which is provided a planar central antenna element 16. In the example of FIG. 9, the antenna element 16 is an Archimedean spiral antenna element. While an Archimedean spiral antenna element is shown in FIG. 9A and described here, it is noted that other planar configurations, such as patch or slot antennas, can be used for the central antenna element 16, if desired.

With further reference to FIG. 9A, a planar electromagnetic bandgap structure 18 is formed on the top surface 14 of the substrate 12. This bandgap structure 18 surrounds the central antenna element 16 and is comprised by a plurality of continuous, concentric conductors that are formed on the top surface 14 in an array. In some embodiments, each conductor comprises a conductive trace that is deposited on the surface 14 using an electrodeposition or printing method. These conductors include grounded conductors 20 having vias 22 that extend through the substrate 12 to an electrically conductive ground plane 24 provided on a bottom surface 26 of the substrate (FIG. 9B), as well as "floating" conductors 28 that comprise no vias and, therefore, are not connected to ground. FIG. 9C is a partial detail view that shows a radial unit cell of the bandgap structure 18 and more clearly illustrates the grounded conductors 20 and the floating conductors 28. As can be appreciated from FIGS. 9A and 9C, the grounded conductors 20 and the floating conductors 28 are each circular and arranged in a spaced, alternating manner such that a grounded conductor is followed by a floating conductor, which is followed by a further grounded conductor and so forth radially outward from an inner edge of the band gap structure 18 to an outer edge of the band gap structure. While the grounded conductors 20 and the floating conductors 28 are illustrated and described as being circular, it is noted that other shapes are possible, such as rectangles, hexagons, and the like. Each of the central antenna element 16, the grounded conductors 20, the ground plane 24, and the floating conductors 28 can be made of a suitable electrically conductive material, such as a metal material.

An example antenna having a configuration similar to that shown in FIG. 9 was designed for experimental purposes. The central antenna element had dimensions that are identical to those of the conventional antenna described above but was surrounded by an electromagnetic bandgap structure comprising an array of grounded and floating concentric annular rings. The grounded rings were 0.64 mm wide and were spaced 1.92 mm apart from each other. Vias to ground with diameters of 0.3048 mm were placed every 11.25° along each grounded ring. The floating rings each had a width of 1.1276 mm and was positioned between each two consecutive grounded rings. The floating and grounded rings were each separated from each other with a 0.3962 mm gap (see FIG. 9C).

The electromagnetic bandgap structure was cylindrically periodic so that a radial unit cell is formed from a slice of the electromagnetic bandgap array sectored halfway between two vias and the center of board, as shown in FIG. 9C. Ansys HFSS eigenmode solver was used to calculate the dispersion diagram for the unit cell along the x direction (i.e., radial direction). The x-directed bandgap was between 1.33 to 6.88 GHz. Only the x-directed dispersion was simulated since the spiral antenna E-field propagated in a direction perpendicular to the electromagnetic bandgap surface. As shown in FIG. 9C, the unit cell comprised a grounded conductor with a 0.64 mm width ($w_{cond_grid}$) and a 0.3048 mm via diameter ($dia_{via}$) positioned between floating conductors with a 1.1276 mm width ($w_{cond_float}$) and a 0.3962 mm gap. The unit cell 9.5504 mm-length ($length_{uc}$) represents the average radial arc length of the electromagnetic bandgap array for an 11.25° via separation ($spacing_{via}$). An average arc length was calculated since the arc length varies from the maximum and minimum radii.

Figure 10:
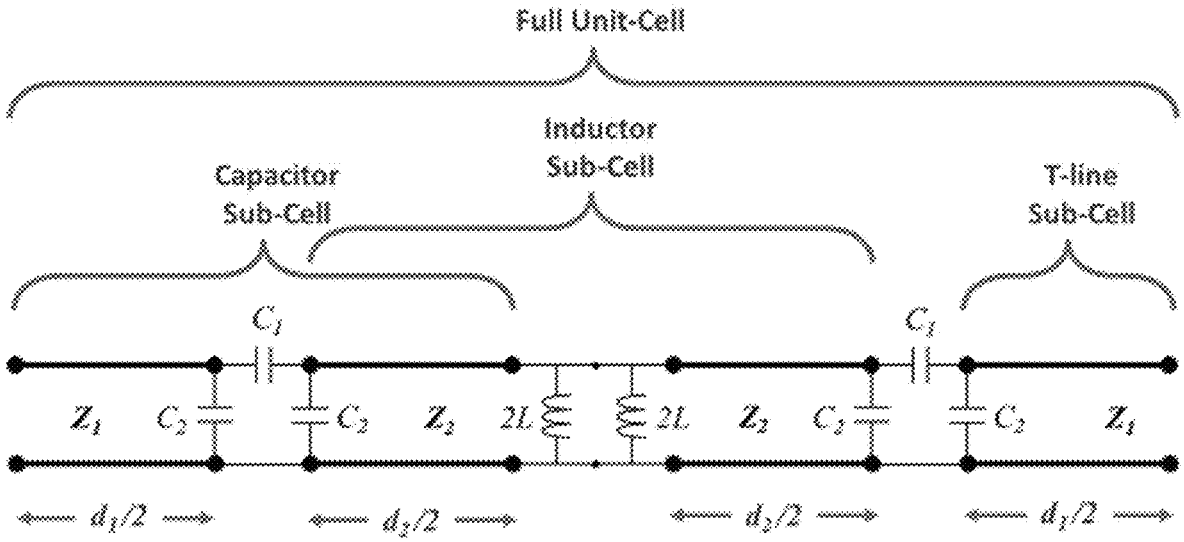
FIG. 10 is a block diagram of an equivalent circuit for the unit cell of FIG. 9C.

The equivalent circuit for the electromagnetic bandgap unit cell is shown in FIG. 10. The unit cell is modelled by (1) a transmission line section of length $0.5 \cdot I_1$, (2) a capacitive pi-network modelling the gaps between t-lines, (3) another transmission line section of length $0.5 \cdot I_2$, and (4) a shunt inductance at the midpoint of the unit cell modelling the via to ground. The unit cell is symmetric about the inductor.

Applying dispersion analysis concepts, the ABCD matrix parameters for a cascade of all unit cell elements are given by $$\begin{bmatrix} A & B \\ C & D \end{bmatrix} = T_{TL_1} T_{C_2} T_{C_1} T_{C_2} T_{TL_2} T_{2L} \blacklozenge T_{2L} T_{TL_2} T_{C_2} T_{C_1} T_{C_2} T_{TL_1} = \tag{5}$$

-continued $$\begin{bmatrix} \cos\left(\frac{\beta l_1}{2}\right) & jZ_0\sin\left(\frac{\beta l_1}{2}\right) \\ jY_0\sin\left(\frac{\beta l_1}{2}\right) & \cos\left(\frac{\beta l_1}{2}\right) \end{bmatrix} \begin{bmatrix} 1 & 0 \\ j\omega C_2 & 1 \end{bmatrix} \begin{bmatrix} 1 & \frac{-j}{2\omega C_1} \\ 0 & 1 \end{bmatrix} \cdot$$

$$\begin{bmatrix} 1 & 0 \\ j\omega C_2 & 1 \end{bmatrix} \begin{bmatrix} \cos\left(\frac{\beta l_2}{2}\right) & jZ_0\sin\left(\frac{\beta l_2}{2}\right) \\ jY_0\sin\left(\frac{\beta l_2}{2}\right) & \cos\left(\frac{\beta l_2}{2}\right) \end{bmatrix}$$

$$\begin{bmatrix} 1 & 0 \\ \frac{-j}{2\omega L} & 1 \end{bmatrix} \cdot \begin{bmatrix} 1 & 0 \\ \frac{-j}{2\omega L} & 1 \end{bmatrix} \begin{bmatrix} \cos\left(\frac{\beta l_2}{2}\right) & jZ_0\sin\left(\frac{\beta l_2}{2}\right) \\ jY_0\sin\left(\frac{\beta l_2}{2}\right) & \cos\left(\frac{\beta l_2}{2}\right) \end{bmatrix}$$

$$\begin{bmatrix} 1 & 0 \\ j\omega C_2 & 1 \end{bmatrix} \cdot \begin{bmatrix} 1 & \frac{-j}{2\omega C_1} \\ 0 & 1 \end{bmatrix} \begin{bmatrix} 1 & 0 \\ j\omega C_2 & 1 \end{bmatrix}$$

$$\begin{bmatrix} \cos\left(\frac{\beta l_1}{2}\right) & jZ_0\sin\left(\frac{\beta l_1}{2}\right) \\ jY_0\sin\left(\frac{\beta l_1}{2}\right) & \cos\left(\frac{\beta l_1}{2}\right) \end{bmatrix}$$

where $T_{TL1}$, $T_{C1}$, $T_{C2}$, $T_{TL2}$, and $T_{2L}$ are the individual transmission matrices of the first t-line section, capacitor $C_1$, capacitor $C_2$, the second t-line section, and inductor L, respectively, and β is the propagation constant of the unloaded line.

The equivalent circuit dispersion relation, which defines the passband of the structure, is given by $$\cos(\theta)=(A+D)/2, \tag{6}$$

where θ is the phase shift across the full unit cell.

Figure 11:
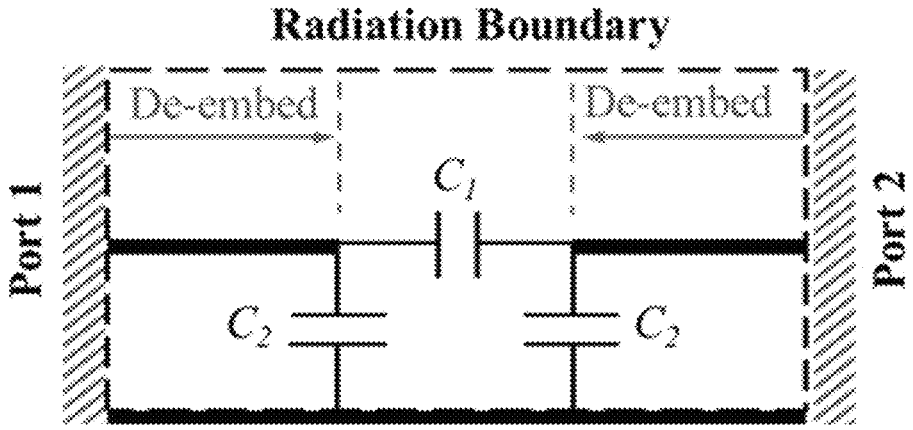
FIG. 11 is a block diagram of an Ansys HFSS setup for a capacitive pi-network shown in FIG. 10.
Figure 12:
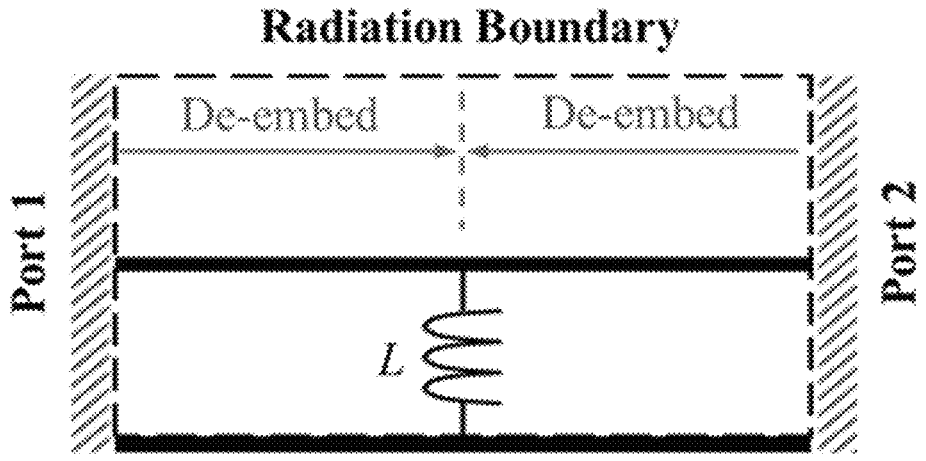
FIG. 12 is a block diagram of an Ansys HFSS setup for an inductor network shown in FIG. 10.
Figure 13:
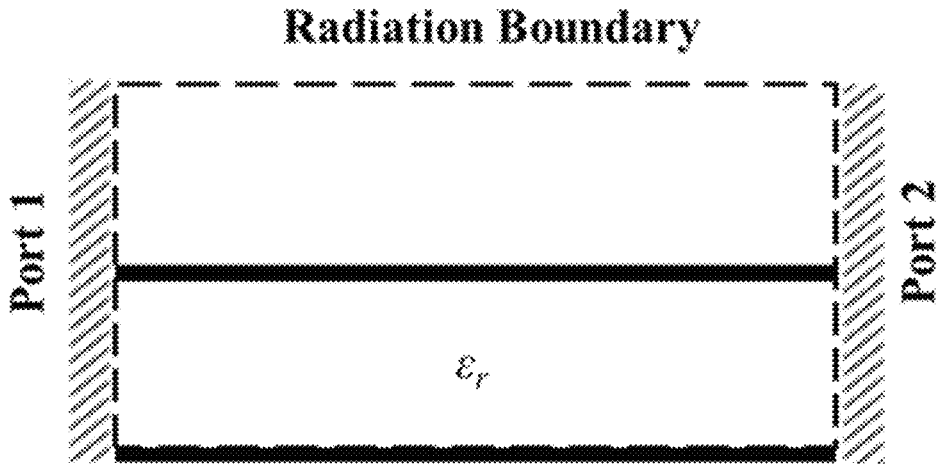
FIG. 13 is a block diagram of an Ansys HFSS setup for a transmission-line network shown in FIG. 10.

While the electromagnetic bandgap unit-cell equivalent circuit is provided above, the lumped element circuit values from the sub-cell elements must be extracted. Ansys HFSS was used to model the scattering parameters of the individual sub-cell elements. The corresponding wave-port setups for the HFSS sub-cell equivalent circuit value extraction are shown for the capacitive pi-network, the shunt inductor network, and the transmission-line network in FIGS. 11, 12, and 13, respectively.

The equivalent circuit lumped element values are extracted for the capacitive pi-network, the shunt inductance, and the transmission line sections using ABCD parameters. The series capacitance $C_{gap}$ in the capacitive pi-network is found by $$C_{gap} = C_1 = \frac{-j}{\omega \cdot imag(Z_C)}, \quad Z_C = \frac{1}{-Y_{12}} \tag{7}$$

where $Z_c$ is the impedance of the capacitive pi-network and $Y_{12}$ are the corresponding y parameters of the capacitive network. The shunt capacitance $C_{shunt}$ in the capacitive pi-network is found by $$C_{shunt} = C_2 = \frac{imag(Y_C)}{j\omega}, \quad Y_C = Y_{11} + Y_{12} \tag{8}$$

where $Y_c$ is the admittance of the capacitive pi-network and $Y_{11}$ are the corresponding y parameters of the capacitive network. The shunt inductance $L_{shunt}$ is found by $$L_{shunt} = L = \frac{-j}{\omega \cdot imag(Y_L)}, \quad Y_L = -\frac{Y_{11}Y_{22} - Y_{12}Y_{21}}{Y_{21}} \tag{9}$$

where $Y_L$ is the admittance of the inductive network and $Y_{11}$, $Y_{21}$, $Y_{21}$, $Y_{22}$ are the corresponding y parameters of the inductive network.

Figure 14:
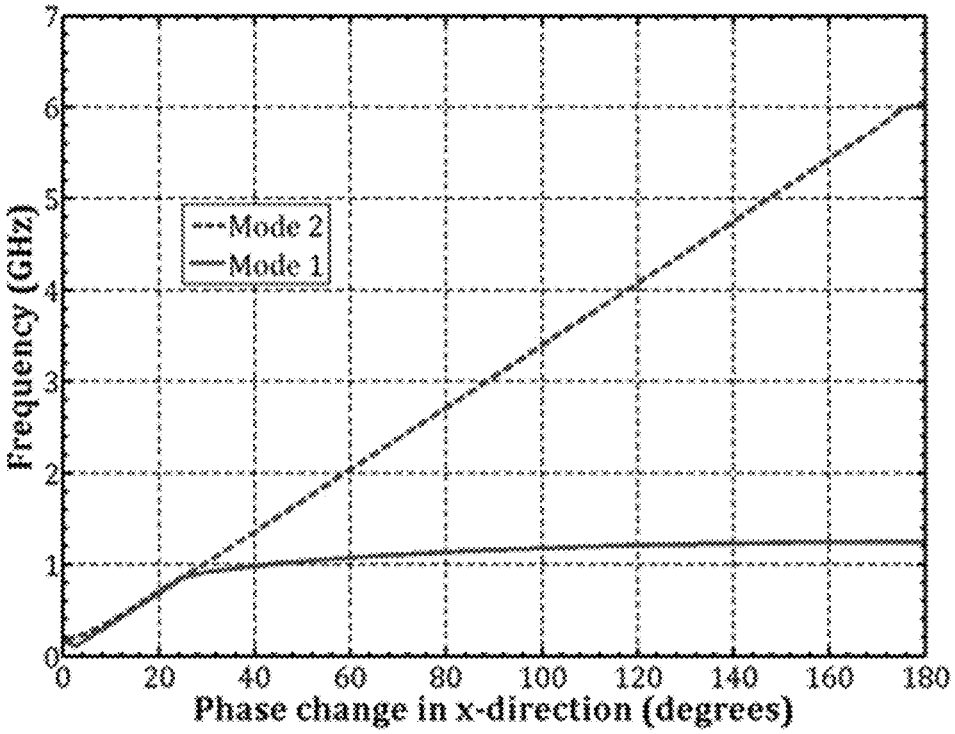
FIG. 14 is an x-directed dispersion diagram for the electromagnetic band gap unit cell using the HFSS eigenmode solver.

Ansys HFSS eigenmode solver was used to simulate the dispersion diagram for the unit cell of the electromagnetic bandgap surface contour along the x direction. The x-directed bandgap, shown in FIG. 14, fell between 1.25 to 5.97 GHz. Only the x-directed dispersion was simulated since the spiral antenna E-field propagates in the direction perpendicular to the electromagnetic bandgap surface.

Figure 15:
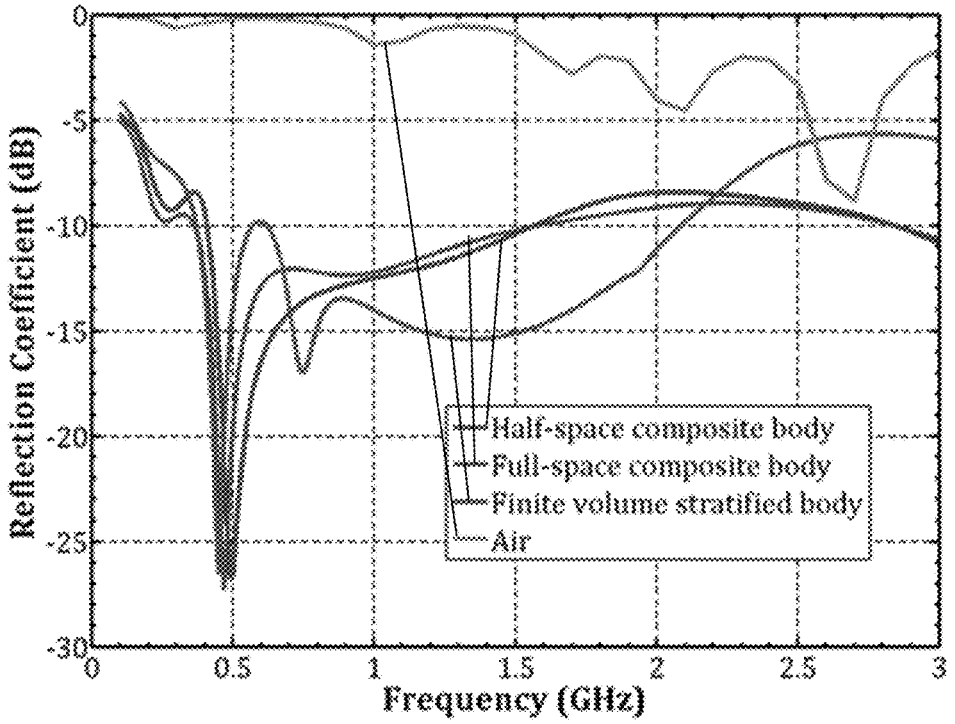
FIG. 15 is a graph that shows a simulated reflection coefficient of electromagnetic bandgap antenna within each propagation environment identified in FIG. 3.
Figure 16:
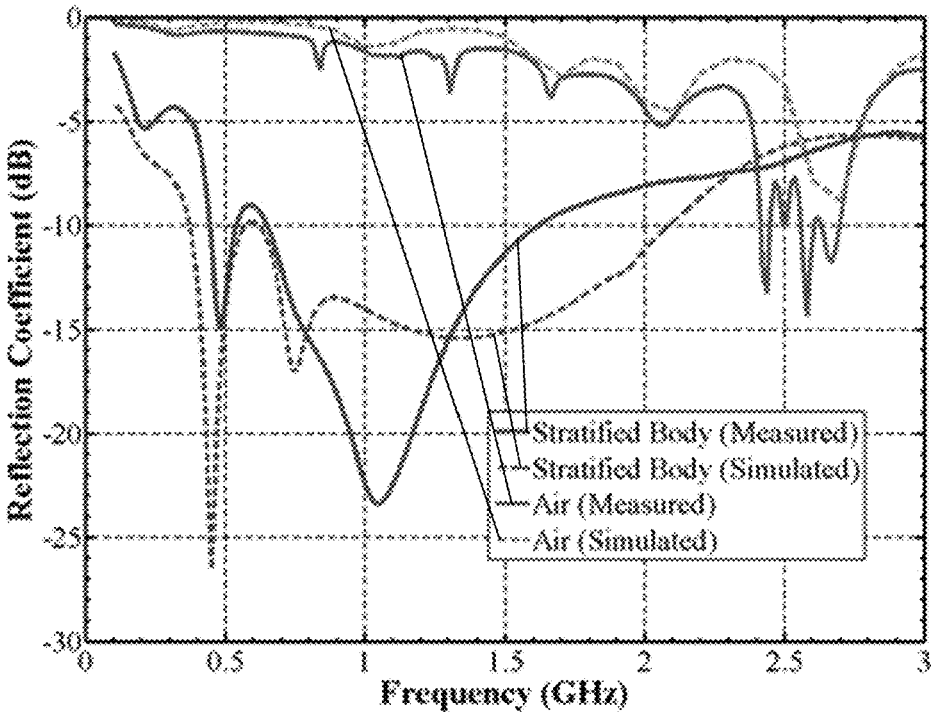
FIG. 16 is a graph that shows a simulated and measured reflection coefficient of electromagnetic bandgap antenna within the propagation environments (a) and (d) identified in FIG. 3.

FIG. 15 shows the simulated reflection coefficients for the electromagnetic bandgap antenna with the four propagation environments of FIG. 3. The reflection properties for the antenna surrounded by the electromagnetic bandgap structure yielded similar responses for both the composite and stratified propagation environments. Again, this comparable reflection coefficient response makes the composite environment ideal for the initial antenna matching design phase. The simulated and measured reflection coefficients for the on-body spiral antenna surrounded by the electromagnetic bandgap are given in FIG. 16. The reflection coefficient is better than −10 dB over the frequency range of 0.65 to 2.1 GHz for the simulated results, and better than −10 dB over the frequency range of 0.65 to 1.6 GHz for the measured results.

Figure 17:
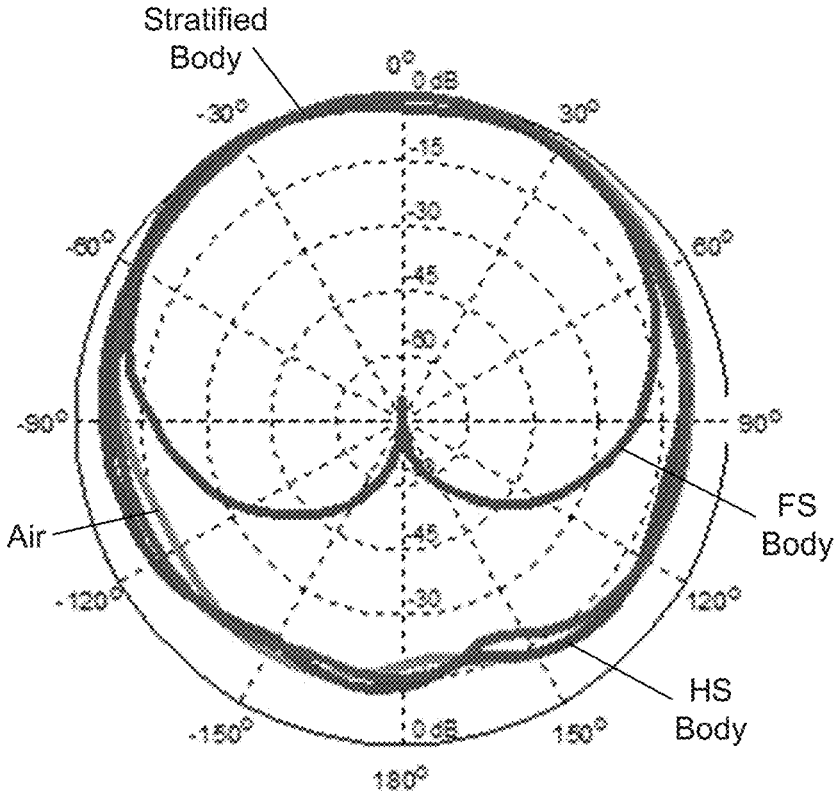
FIG. 17 is a diagram that shows a simulated radiation pattern for electromagnetic bandgap antenna within each of the propagation environment identified in FIG. 3.
Figure 18:
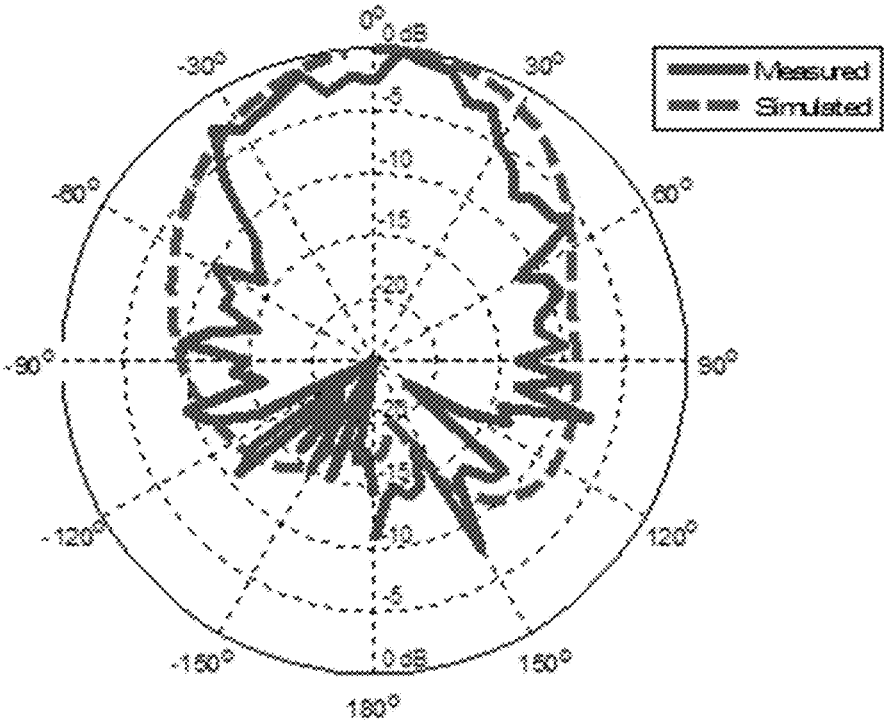
FIG. 18 is a diagram that shows a simulated (dashed line) and measured (solid line) normalized gain (dB) of an electromagnetic bandgap spiral antenna in contact with a human tissue phantom.
Figure 19A:
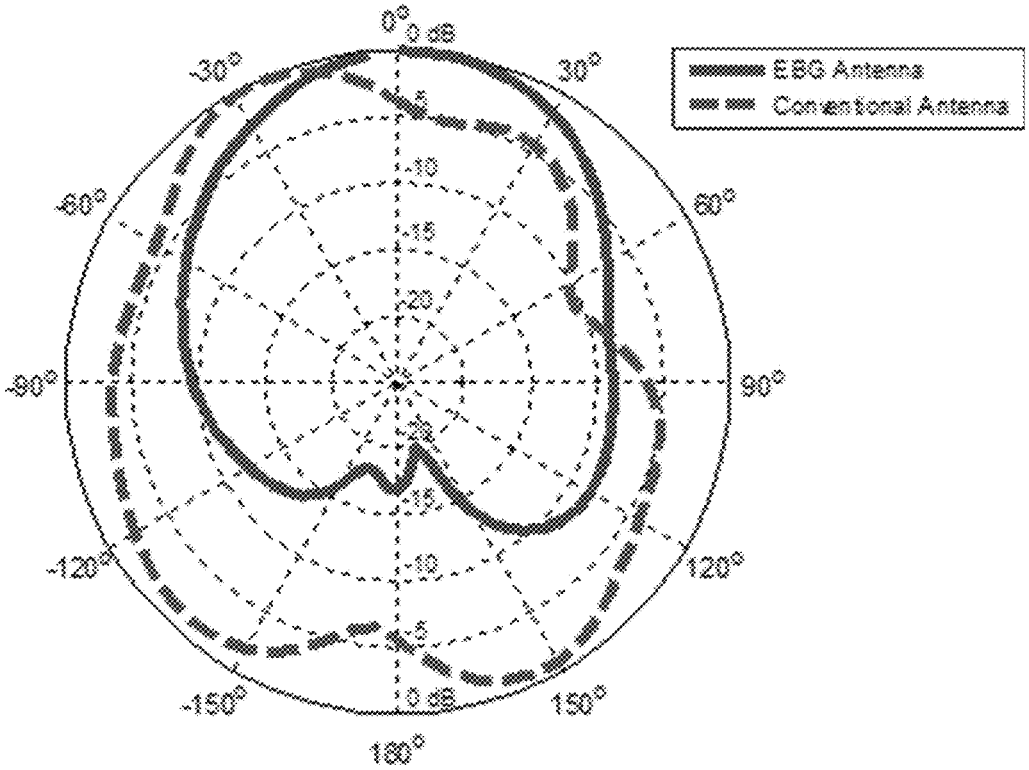
FIG. 19A is a diagram that shows a simulated normalized gain (dB) of electromagnetic bandgap spiral antenna versus a conventional spiral antenna in contact with a human tissue phantom.
Figure 19B:
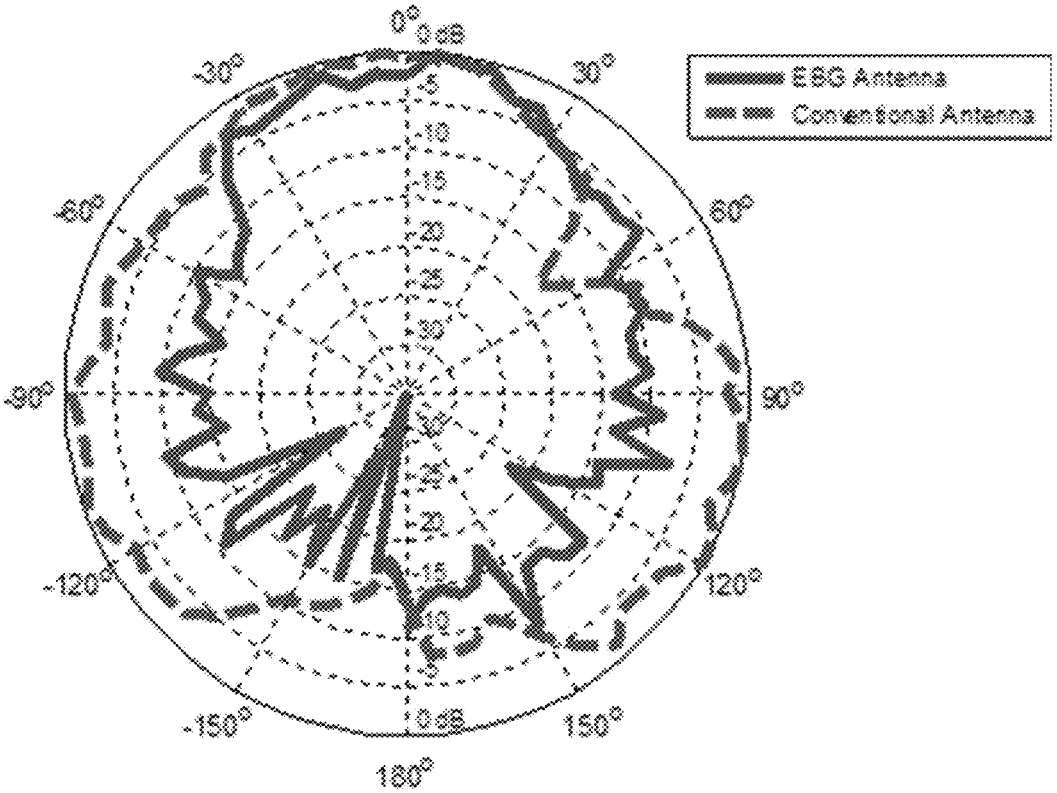
FIG. 19B is a diagram that shows a measured normalized gain (dB) of electromagnetic bandgap spiral antenna versus a conventional spiral antenna in contact with a human tissue phantom.

The normalized realized gains for the four simulated cases are given in FIG. 17. All cases exhibited higher broadside gains than in any other direction. The simulated and measured normalized gains for the on-body electromagnetic bandgap spiral antenna at 1.4 GHz are given in FIG. 18. The maximum side lobe were rear lobe are approximately 7 dB and approximately 8 dB lower, respectively, than the broadside value in both cases. FIGS. 19A and 19B compare the radiation characteristics of the electromagnetic bandgap spiral antenna to the conventional antenna for the same on-body stratified propagation environment. A noticeable appreciation to the forward-propagating antenna pattern is seen for both the simulated (FIG. 19A) and measured (FIG. 19B) scenarios. The electromagnetic bandgap spiral normalized gain has the following improvements over the respective simulated and measured conventional antenna gain: broadside gain approximately 3.84 dB/0 dB, side gain approximately 2.64 dB/7 dB, and rear gain approximately 8 dB/7 dB.

The simulated and measured main beam efficiency at 1.4 GHz for the propagation environment (c), where the electromagnetic bandgap spiral antenna is in contact with a finite volume multi-layered upper space dielectric body, are 87.59% and 86.36%, respectively.

The invention claimed is:

1. An antenna comprising:

a dielectric substrate having a first surface and a second surface opposite to the first surface;

a planar central antenna element provided on the first surface; and a planar electromagnetic bandgap structure provided on the first surface and surrounding the central antenna element, wherein the planar electromagnetic bandgap structure comprises multiple continuous, concentric conductors.

2. The antenna of claim 1, wherein the dielectric substrate has a thickness of less than one quarter the operating wavelength of the antenna.

3. The antenna of claim 1, wherein the planar central antenna element is a spiral antenna element.

4. The antenna of claim 1, wherein the planar central antenna element is an Archimedes spiral antenna element.

5. The antenna of claim 1, wherein the concentric conductors are conductor traces that have been deposited on the first surface.

6. The antenna of claim 1, wherein the concentric conductors are circular.

7. The antenna of claim 1, further comprising a ground plane provided on the second surface of the dielectric substrate.

8. The antenna of claim 7, wherein the concentric conductors include grounded conductors that are electrically connected to the ground plane with vias that extend through the dielectric substrate.

9. The antenna of claim 8, wherein the concentric conductors further include floating conductors that are not electrically connected to the ground plane.

10. The antenna of claim 9, wherein the grounded conductors and floating conductors are arranged in a spaced, alternating manner such that every other concentric conductor from an inner edge of the electromagnetic bandgap structure to an outer edge of the electromagnetic bandgap structure is either a grounded conductor or a floating conductor.

11. An on-body, inward-facing antenna comprising:

a dielectric substrate having a first surface and a second surface opposite to the first surface;

a planar central antenna element provided on the first surface;

a ground plane provided on the second surface; and a planar electromagnetic bandgap structure provided on the first surface and surrounding the central antenna element, the electromagnetic bandgap structure comprising multiple continuous, concentric conductors that include grounded conductors that are electrically connected to the ground plane with vias that extend through the dielectric substrate and floating conductors that are not electrically connected to the ground plane, wherein the grounded conductors and floating conductors are arranged in a spaced, alternating manner such that every other concentric conductor from an inner edge of the electromagnetic bandgap structure to an outer edge of the electromagnetic bandgap structure is either a grounded conductor or a floating conductor.

12. A method for limiting the generation of unwanted side lobes from a radiating planar antenna element provided on a surface of a substrate, the method comprising:

forming a planar electromagnetic bandgap structure on the substrate surface in a manner in which it surrounds the central antenna element, wherein the electromagnetic bandgap structure comprises multiple continuous, concentric conductors.

13. The method of claim 12, wherein forming a planar electromagnetic bandgap structure comprises depositing metal traces to create the multiple continuous, concentric conductors.

14. The method of claim 13, wherein forming a planar electromagnetic bandgap structure further comprises forming vias through a subset of the concentric conductors that extend down to a ground plane provided on an opposite surface of the substrate such that the subset of concentric conductors are grounded conductors and the concentric conductors that are not connected to the ground plane are floating conductors.

* * * * *